United States Patent [19]

Horton

[11] 4,430,275

[45] Feb. 7, 1984

[54] DUAL BOWL METERING BLOCK FOR ALCOHOL AND/OR NITRO-METHANE BURNING CARBURETOR AND METHOD OF CONVERSION

[75] Inventor: Johnnie A. Horton, Tulsa, Okla.

[73] Assignee: Leroy Penrod; John A. Stutsman, both of Tulsa, Okla., part interest to each

[21] Appl. No.: 407,709

[22] Filed: Aug. 13, 1982

[51] Int. Cl.[3] ..... F02M 11/02

[52] U.S. Cl. ..... 261/18 B; 261/23 A; 261/34 R; 261/72 R; 261/DIG. 50

[58] Field of Search ..... 261/34 R, 18 B, DIG. 50, 261/23 A, 72 R

[56] References Cited

U.S. PATENT DOCUMENTS

| | | | |
|---|---|---|---|
| 2,358,435 | 9/1944 | Ball | 261/23 A |
| 2,556,463 | 6/1951 | Bicknell | 261/18 B |
| 2,748,796 | 6/1956 | Schweiss | 261/DIG. 50 |
| 2,892,622 | 6/1959 | Goodyear | 261/72 R |
| 2,973,947 | 3/1961 | Sterner | 261/DIG. 50 |
| 3,061,285 | 10/1962 | Garski et al. | 261/23 A |
| 3,807,707 | 4/1974 | Johnson | 261/34 R |
| 4,003,968 | 1/1977 | Rickert | 261/34 R |
| 4,085,720 | 4/1978 | Etoh | 261/18 B |
| 4,277,423 | 7/1981 | Noguez | 261/34 R |
| 4,289,714 | 9/1981 | Duncan et al. | 361/34 R |

OTHER PUBLICATIONS

"Convert Your Car to Run on Alcohol Fuel," Automotive Engineering Publications, Burgess Pub. Co., 7108 Ohms Lane, Minneapolis, Minn. 55435, Apr. 1980.

*Primary Examiner*—Tim R. Miles
*Attorney, Agent, or Firm*—Head, Johnson & Stevenson

[57] ABSTRACT

An improved carburetor metering block for converting a conventional gasoline carburetor to alcohol fuel involving a carburetor metering block means adapted to attach to a conventional carburetor and replace the removable fuel bowl and standard metering block wherein the improved carburetor metering block means is adapted to accept, simultaneously, a plurality of individual and separate fuel bowls. Such a device can inexpensively convert a conventional carburetor to the use of alcohol fuel consistent with sufficient fuel flow and adequate fuel level control.

5 Claims, 6 Drawing Figures

DUAL BOWL METERING BLOCK FOR ALCOHOL AND/OR NITRO-METHANE BURNING CARBURETOR AND METHOD OF CONVERSION

BACKGROUND OF THE INVENTION

1. Field of the Invention:

This invention relates to the conversion of a standard gasoline carburetor to an alcohol and/or nitro-methane fueled carburetor. More specifically, the invention relates to a metering block that accepts a pair of alcohol containing fuel bowls.

2. Description of the Prior Art:

The basic concept of operating an internal combustion engine using alcohol as the fuel is a well established practice, particularly in certain high performance areas such as racing. Thus, the alcohol burning race car, hydroplane, motorcycle or the like, is generally known but is also considered to be for a specialty type event. In fact, alcohol has sometimes been categorized as an exotic fuel. To a great extent, this label is a consequence of the contemporary mass production of internal combustion engines being almost exclusively directed to either gasoline or diesel fuel systems, wherein the carburetor must be essentially reengineered to be made compatible with alcohol fuel. More specifically, it is known that for maximum power output, an alcohol burning engine needs a fuel to air ratio in the region of 5.5 or 6.5 whereas the maximum power output for the gasoline engine occurs at about 13. Yet, it is also generally accepted that alcohol has an inherent resistance to detonation (resists preignition and spark knock) and low combustion temperatures, making it highly suitable for high compression racing engine applications. Furthermore, with the advent of contemporary emission laws and the consequential redirection of selected gasoline feed stocks into unleaded gasoline production, the price of ultra-high octane racing fuel has increased to such an extent that the use of alcohol fuel is becoming cost effective.

Although, as indicated above, the conversion of the standard gasoline engine to an alcohol fueled racing engine is in principle attractive, up to this point in time the conversion has been expensive. Either the carburetor is replaced by an alcohol carburetor specifically manufactured for such purpose or the stock gasoline carburetor has to be completely reengineered (frequently leading to unsatisfactory results). Thus, the need for an inexpensive yet reliable method of adapting a conventional gasoline carburetor to alcohol fuel is still present.

SUMMARY OF THE INVENTION

In view of the problems and expense of converting a conventional gasoline carburetor to operate an alcohol fuel, I have discovered an improved carburetor metering block that is adapted to replace the conventional carburetor metering block and accept, simultaneously, a pair of separate conventional fuel bowls each supplying alcohol or other exotic fuel to the engine. In this manner, the present invention provides sufficient fuel flow and adequate control of fuel level, while using predominantly conventional carburetor components. Thus, the present invention provides in a carburetor having at least one removable fuel bowl and metering block the specific improvement comprising: a carburetor metering block means adapted to attach to the carburetor and replace the removable fuel bowl and metering block, and the carburetor metering block means is further characterized in that it is adapted to accept, simultaneously, a plurality of individual and separate fuel bowls.

In one embodiment of the present invention, the carburetor metering block means has a pair of fuel bowls feeding a two barrel carburetor, while in another embodiment, two carburetor metering block means, each with a pair of fuel bowls, are feeding a four barrel carburetor.

It is a primary object of the present invention to provide an inexpensive, yet reliable way of converting a conventional gasoline carburetor to alcohol and/or nitromethane fuel. It is an associated object to accomplish the conversion such that a plurality of alcohol fuel bowls will simultaneously feed fuel through the carburetor such that both sufficient fuel flow and adequate fuel level control are accomplished. Fulfillment of these objects and the presence and fulfillment of other objects will be apparent upon reading of the specification and claims taken in conjunction with the attached drawings.

DESCRIPTION OF THE PREFERRED EMBODIMENTS

The improved carburetor metering block of the present invention, how it is used to convert a standard carburetor to alcohol-type fuels and how its use overcomes certain problems implicit in such conversions can perhaps be best explained and understood by reference to the drawings.

Figure 1:
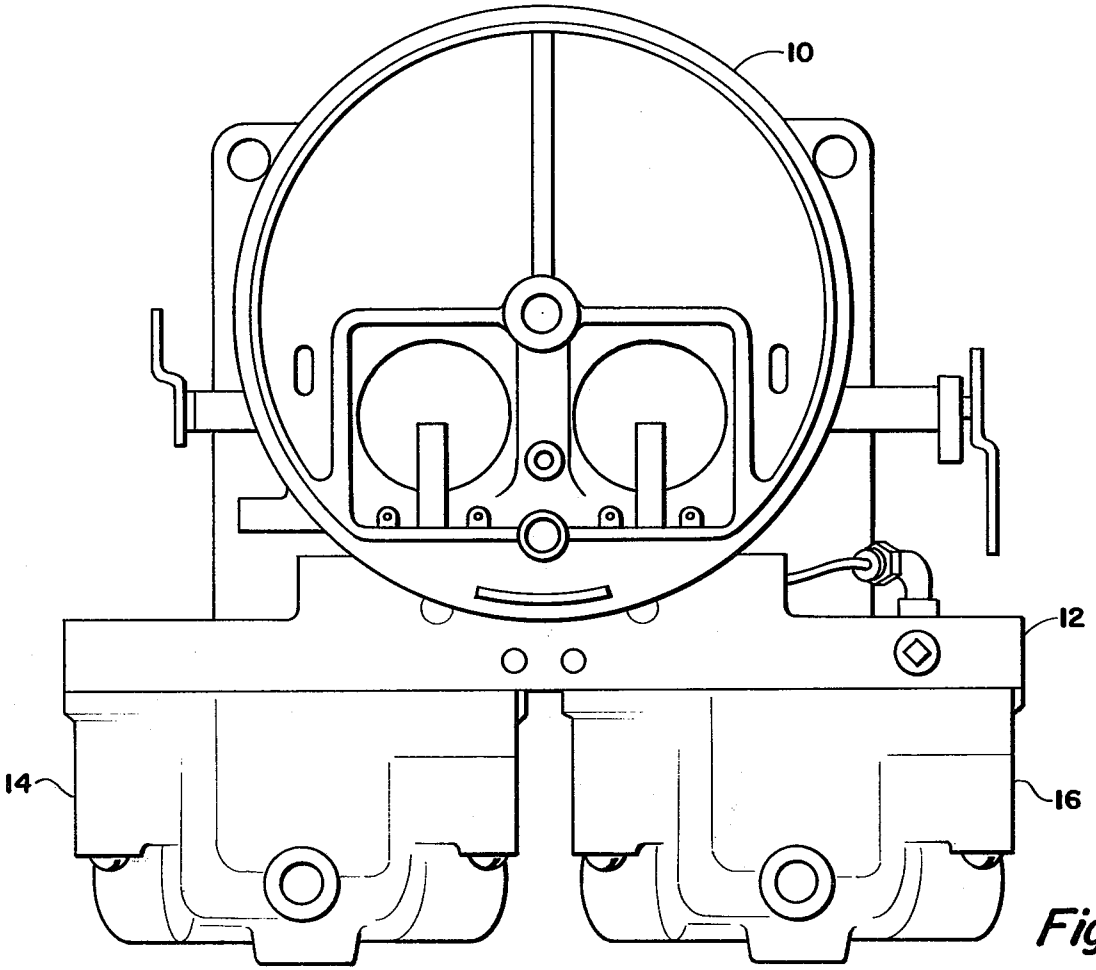
FIG. 1 is a top view of a conventional two-barrel carburetor equipped with a pair of fuel bowls mounted to the improved metering block according to the present invention.
Figure 2:
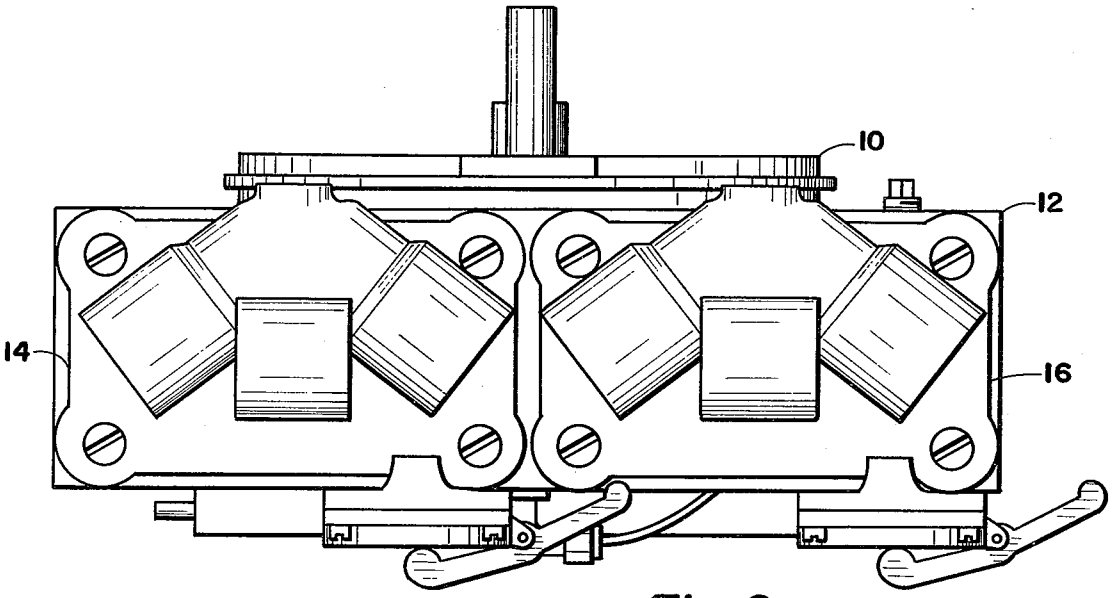
FIG. 2 is a front view of the carburetor illustrated in FIG. 1 as seen through line A—A.

FIGS. 1 and 2 are a top and front view, respectively, of a standard two-barrel Holly carburetor 10 equipped with a dual fuel bowl metering block 12 according to the present invention. This metering block 12 is designed to replace the original metering block by attaching to the carburetor at the same relative position as the original. Attached to the front face of the metering block 12 are a pair of standard or conventional fuel bowls 14 and 16 with separate fuel inlet needle-valves with seat and internal fuel float.

The overall use of the multiple fuel bowl metering block is readily applicable to any gasoline carburetor that has a removable metering block and fuel bowl, but, in principle, it can also be utilized with any carburetor that can be converted to the detachable metering block concept. Furthermore, more than one multiple fuel bowl metering block can readily be used on a single carburetor such as when replacing both the primary and secondary metering blocks of a four-barrel carburetor.

Figure 3:
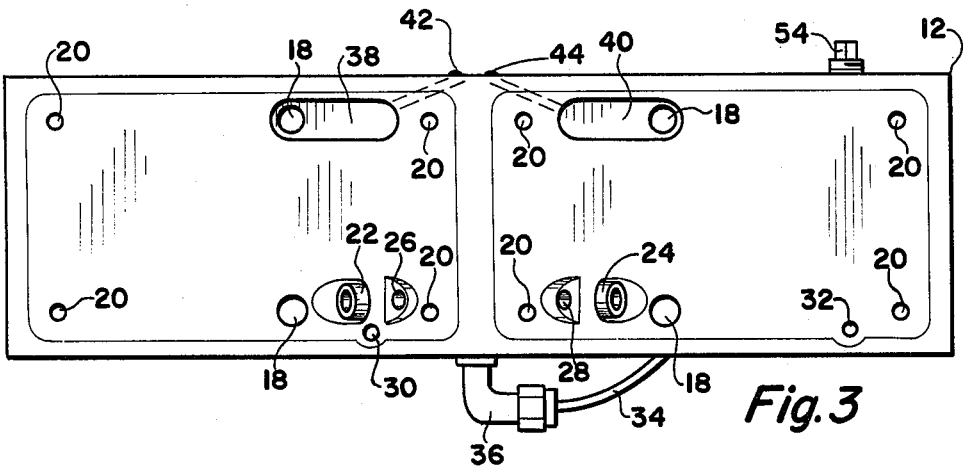
FIG. 3 is a front view of the metering block illustrated in FIG. 1 removed from the carburetor.

FIG. 3 illustrates the front face of the metering block 12 with the fuel bowls removed. The metering block attaches to the carburetor through a set of bolt holes 18 which are aligned with the points of attachment on the original metering block. A series of eight threaded holes 20 are provided to accept and retain attachment bolts at the four corners of the pair of fuel bowls mounted to the front face of the metering block 12 (see FIGS. 1 and 2). At the lower central corner of each fuel bowl are the fuel inlets to the main fuel circuit. Each inlet involves a replaceable main jet 22 and 24 and an auxiliary main jet 26 and 28 of fixed or constant size that diagonally intersect within the metering block forming part of the main fuel circuit. Each fuel circuit supplies a separate venturi within the carburetor throat; i.e., each barrel of the carburetor is supplied by its own fuel bowl. In this manner, the two-fold or greater increase in the rate of fuel delivered to the engine (approximately corresponding to the required relative change in fuel to air ratio when converting from gasoline to alcohol) can be readily achieved. In essence, each venturi of the two-barrel carburetor will now be supplied with liquid fuel at a rate in excess of the previous sum of fuel flow rates to both venturis; yet, the absolute liquid flow rate within the individual fuel bowls and through the respective needle and seat will be approximately the same as before the conversion.

As further illustrated in FIG. 3, the auxiliary main jets 26 and 28 are fixed, while the main jets 22 and 24 are replaceable. In this manner, a total fuel flow rate in excess of twice the previous flow rate can be achieved while the fine tuning or final jetting of each system can be performed with the use of already available replaceable jet sizes. Also, from the front side view of FIG. 3 the metering block fuel inlet ports 30 and 32 for the accelerator pump circuit can be seen at the right corner of each fuel bowl. These fuel inlets 30 and 32 ultimately deliver fuel through external tube 34 and fitting 36 to the metering block accelerator injection circuit as explained later. The elongated openings 38 and 40 which encompass the upper inner pair of attachment bolt holes 18 also serve as part of the air vent or bowl vent circuit by virtue of the diagonal ports (dashed lines) that extend upward to the pair of peened ball bearings 42 and 44 (see also FIG. 4).

It should be apparent from FIG. 3 that the metering block 12 differs from a conventional metering block by the absence of the intermediate power circuit. The elimination of the power circuit is viewed as a matter of convenience and choice in that the illustrated embodiment is intended for an all out racing version of the invention. As such, the power circuit is optional, but is considered compatible with the present invention and may be present in alternate embodiments.

Figure 4:
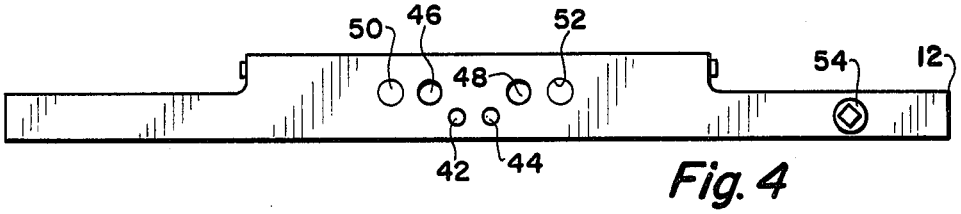
FIG. 4 is a top view of the metering block illustrated in FIG. 3.

As seen in the metering block top view of FIG. 4, the pair of peened ball bearings 42 and 44 cap the air bowl vent circuit. To each side of these ball bearings are the sealed main fuel wells 46 and 48 followed by the sealed idle wells 50 and 52. The the far right side is the plugged accelerator pump well 54.

Figure 6:
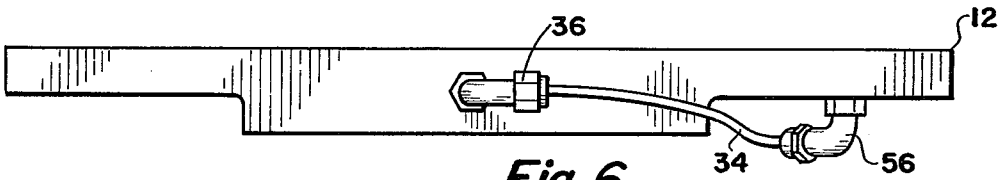
FIG. 6 is a bottom view of the mtering block illustrated in FIG. 3.
Figure 5:
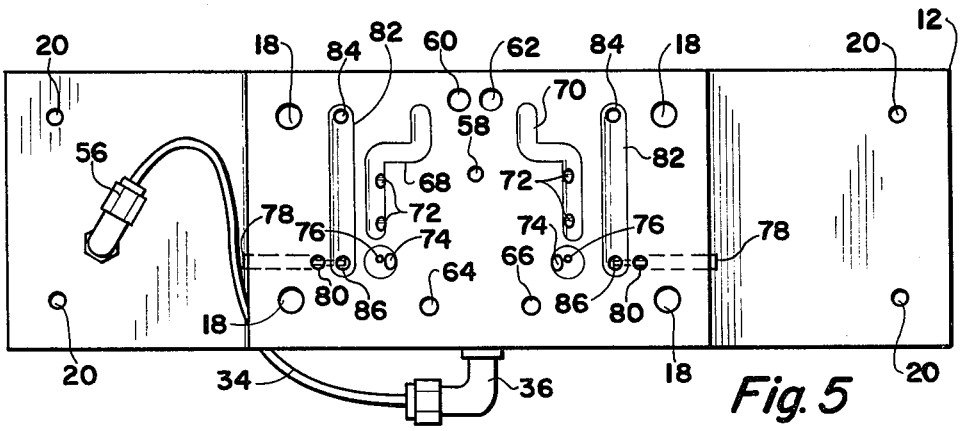
FIG. 5 is a back view of the metering block illustrated in FIG. 3.

FIG. 5 illustrates the reverse or back side of the metering block 12. The external portion of the accelerator pump circuit including tube 34 and lower fitting 36 can be seen to connect to metering block 12 at fitting 56, such that the fuel can be ultimately delivered to the accelerator pump discharge passage 58. Directly above the accelerator pump discharge passage 58 is a pair of bowl vent passages 60 and 62. Symmetrically located to each side of the discharge passage 58 and bowl vent passages 60 and 62 are separate main fuel circuit discharge nozzles 64 and 66, main air wells 68 and 70 with air bleed holes 72 into main well and idle fuel ports 74 from main well and idle fuel restrictions to idle well 76. Each of these separate circuits is associated with the individual and separate fuel bowls to be attached on the other side. Also, two separate idle circuits can be seen in FIG. 4, including separate needle valves 78, curb idle discharge ports 80, idle down wells 82, idle air bleed openings 84 and idle-transfer fuel openings 86. The underside or bottom view of FIG. 6 again shows the external accelerator pump circuit with external fittings 36 and 56 and tube 34.

Thus, as described above, the multi or dual float metering block of the present invention and the associated method of converting a conventional gasoline fuel carburetor to alcohol fuel, can be accomplished by employing predominantly standard or conventional components once the metering block of the present invention is available. Some modification to the throat of the carburetor may be appropriate such as enlarging the main fuel circuits to each venturi; however, this is viewed as a conventional consideration in auto racing and the like. Also, the use of a dual or multiple accelerator pump linkage system is viewed as advantageous and the appropriate fuel pump/pressure regulator as known in the art should be employed.

Thus, the general concept of using a dual float metering block of the present invention is viewed as a replacement type modification not necessarily requiring total reengineering of the carburetor. The number of additional fuel bowls added is a matter of choice. Preferably a two for one conversion should be sufficient, however, for extremely large fuel requirements, the three for one conversion can be, in principle, accomplished. Also, the concept of replacing both the primary and secondary metering block on a four-barrel carburetor with a so-called four corner accelerator pump circuit is viewed as compatible with the basic concept of the present invention.

The metering block can be manufactured out of essentially any of the materials well known in the art. The particular physical appearance and respective circuits can be made compatible with various specific carburetor requirements and should not be limited to the details of the illustrated embodiment. Various circuits can be made external to the block, if necessary, or incorporated within the metering block. Thus, for example, the external accelerator pump circuit of the illustrated embodiment can be readily incorporated within the metering block.

Having thus described and exemplified the preferred embodiment with a certain degree of particularity, it is manifest that many changes can be made within the details of construction, arrangement and fabrication of the components and their uses without departing from the spirit and scope of this invention. Therefore, it is to be understood that the invention is not limited to the embodiments set forth herein for purposes of exemplification, but is to be limited only by the scope of the attached claims, including the full range of equivalents to which each element thereof is entitled.

I claim:

1. In a carburetor having at least one removable fuel bowl and metering block the specific improvement comprising: a carburetor metering block means adapted to attach to said carburetor and replace said removable fuel bowl and metering block and said carburetor metering block means is further characterized in that it is adapted to accept, simultaneously, a plurality of individual and separate fuel bowls.

2. An improved carburetor according to claim 1 wherein said carburetor metering block means has a pair of fuel bowls feeding a two-barrel carburetor throat.

3. An improved carburetor according to claim 1 wherein two of said carburetor metering block means, each with a pair of fuel bowls, feed a four barrel carburetor throat.

4. A method of converting a gasoline fueled carburetor to alcohol and/or nitro-methane fuel comprising the step of: replacing the carburetor metering block with a carburetor metering block means adapted to attach to said carburetor and accept, simultaneously, a plurality of individual and separate fuel bowls.

5. A method of claim 4 wherein there are two fuel bowls attached to said metering block means.

* * * * *